US008128198B2

(12) United States Patent
Kemma

(10) Patent No.: US 8,128,198 B2
(45) Date of Patent: Mar. 6, 2012

(54) IMAGE FORMING APPARATUS INCLUDING CARRIAGE WITH RECORDING HEAD

(75) Inventor: Tsuguyori Kemma, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 435 days.

(21) Appl. No.: 12/319,525

(22) Filed: Jan. 8, 2009

(65) Prior Publication Data

US 2009/0174749 A1 Jul. 9, 2009

(30) Foreign Application Priority Data

Jan. 8, 2008 (JP) ..... 2008-001690

(51) Int. Cl.
*B41J 23/00* (2006.01)
*B41J 2/14* (2006.01)

(52) U.S. Cl. ..... 347/37; 347/50

(58) Field of Classification Search ..... 347/37, 347/50, 58
See application file for complete search history.

(56) References Cited

U.S. PATENT DOCUMENTS 5,570,118 A * 10/1996 Rezanka et al. ..... 347/43
6,318,840 B1 * 11/2001 Sette et al. ..... 347/37
6,773,090 B2 * 8/2004 Baldwin-Garcia ..... 347/43
2006/0103707 A1 * 5/2006 Askeland et al. ..... 347/101
2006/0232621 A1 * 10/2006 Hayamizu et al. ..... 347/19

FOREIGN PATENT DOCUMENTS

| | | |
|---|---|---|
| JP | 58-68368 | 4/1983 |
| JP | 2002-154213 | 5/2002 |
| JP | 2004-66576 | 3/2004 |
| JP | 3637413 | 1/2005 |
| JP | 2005-349792 | 12/2005 |
| JP | 2006-192624 | 7/2006 |
| JP | 2006-212798 | 8/2006 |

OTHER PUBLICATIONS

Apr. 21, 2010 Chinese official action in connection with a counterpart Chinese patent application.

* cited by examiner

*Primary Examiner* — Geoffrey Mruk
(74) *Attorney, Agent, or Firm* — Cooper & Dunham LLP

(57) ABSTRACT

An image forming apparatus includes a first carriage, a second carriage, an endless belt member, and a driving source. The first carriage further includes a recording head. The second carriage further includes one or more electrical components. The endless belt member is extended between a driving pulley and a driven pulley. The first carriage and the second carriage are connected to the endless belt member at diagonally opposed positions. The driving source rotates the driving pulley, moving the belt member to move the first carriage and the second carriages in opposite directions.

9 Claims, 7 Drawing Sheets

IMAGE FORMING APPARATUS INCLUDING CARRIAGE WITH RECORDING HEAD

CROSS-REFERENCE TO RELATED APPLICATIONS

The present patent-application claims priority pursuant to 35 U.S.C. §119 from Japanese Patent Application No. 2008-001690, filed on Jan. 8, 2008 in the Japan Patent Office, the entire contents of which are hereby incorporated herein by reference.

BACKGROUND

1. Technical Field

This disclosure relates to an image forming apparatus including a carriage on which a recording head is mounted.

2. Description of the Background

Image forming apparatuses are used as printers, facsimile machines, copiers, plotters, and multi-functional devices combining several of the foregoing capabilities. As one such image forming apparatus an inkjet recording apparatus is known that employs a liquid-ejection recording method, in which the apparatus performs image formation (hereinafter, recording, printing, and imaging are used as synonyms thereof) by ejecting ink droplets from a recording head onto a sheet transported from a sheet tray.

Liquid-ejection image forming apparatus may be further classified into serial-type and line-type apparatuses. A serial-type image forming apparatus moves a recording head in a main scan direction while ejecting droplets therefrom to form an image, whereas a line-type image forming apparatus uses a line head to eject droplets without moving the recording head.

A conventional serial-type image forming apparatus includes a carriage scanning mechanism to reciprocally move, or scan, a carriage containing a recording head back and forth in a direction perpendicular to a direction in which a sheet is transported. In the carriage scanning mechanism, the carriage is connected to a timing belt extended between a driving pulley and a driven pulley, and the driving pulley is rotated by a driving motor.

In one example, a conventional printer includes in the carriage a document reading unit to read an image of a document by scanning the document in a width direction perpendicular to a transport direction of the document and a printing unit to print a recording sheet using an inkjet print method by scanning the recording sheet in a width direction perpendicular to a transport direction of the recording sheet. The printing unit has substantially the same weight as the document reading unit, and the document and the recording sheet are transported along a transport path common to the document reading unit and the printing unit. Further, a drive-force-transmitting linear member for transmitting drive force from a common driving source is disposed in such an endless loop form that linear portions at both ends extend in a width direction of the transport path, and the document reading unit and the printing unit are mounted on the respective linear portions located at substantially diagonally opposed positions with respect to the center of the loop of the linear member.

As the weight of the carriage mounting a recording head becomes heavier, the inertial force of the carriage during scanning increases. Therefore, a relatively heavy carriage may cause vibration or shock upon impact to an image forming apparatus as the carriage reaches the end of its scan run.

Conventionally, a balancer or an image reading unit having the same weight as a carriage is employed to suppress such vibration or shock. However, little attempt has been made to reduce the weight of the carriage itself.

BRIEF SUMMARY

In an aspect of this disclosure, there is provided an image forming apparatus including a weight-reduced carriage mounting a recording head.

In another aspect, an image forming apparatus includes an image forming unit, a first carriage, a second carriage, an endless belt member, and a driving source. The first carriage further includes a recording head. The second carriage further includes one or more electrical components. The endless belt member is extended between a driving pulley and a driven pulley. The first carriage and the second carriage are connected to the endless belt member at diagonally opposed positions. The driving source rotates the driving pulley, moving the belt member to move the first carriage and the second carriage in opposite directions.

BRIEF DESCRIPTION OF THE DRAWINGS

A more complete appreciation of the aforementioned and other aspects, features and advantages will be better understood by reference to the following detailed description when considered in connection with the accompanying drawings, wherein.

Figure 1:
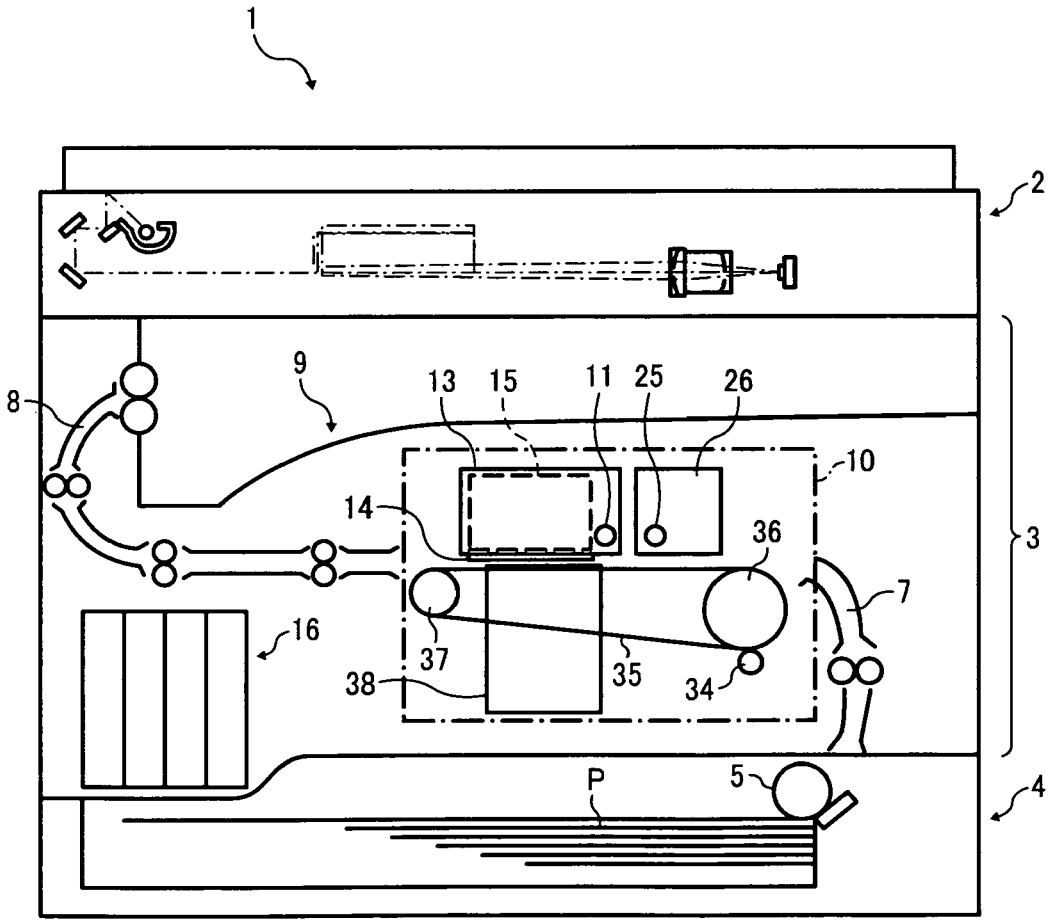
FIG. 1 is a schematic view illustrating a configuration of an image forming apparatus according to an illustrative embodiment of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

The term "image forming apparatus" as used herein refers to an apparatus capable of forming an image by landing ink on a medium, such as paper, string, fiber, cloth, leather, metal, plastic, glass, timber, ceramic, or the like. Further, "image formation" used herein refers to providing not only images with explicit meaning, such as character codes or figures, but also images without explicit meaning, such as patterns, to a medium as described above, and includes landing liquid droplets on such a medium. Moreover, "ink" as used herein is not limited to so-called ink but includes recording liquid, fixing agents and other liquid useable for image formation. "Sheet" as used herein is not limited to paper material but may include OHP sheet, cloth, and other materials as described above, to which ink droplets are adhered. The sheet also includes a medium, a recorded medium, a recording medium, a sheet material, a transfer material, a recording sheet, a paper sheet, and the like.

Below, illustrative embodiments according to the present disclosure are described with reference to the attached drawings.

First, an image forming apparatus 1 according to an illustrative embodiment of the present disclosure is described with reference to FIGS. 1 to 6. It is to be noted that, although the image forming apparatus 1 is a copier, the configuration of image forming apparatus is not limited to that of a copier but may be a printer, a facsimile machine, a plotter, or a multi-functional device combining several of the foregoing capabilities.

Figure 2:
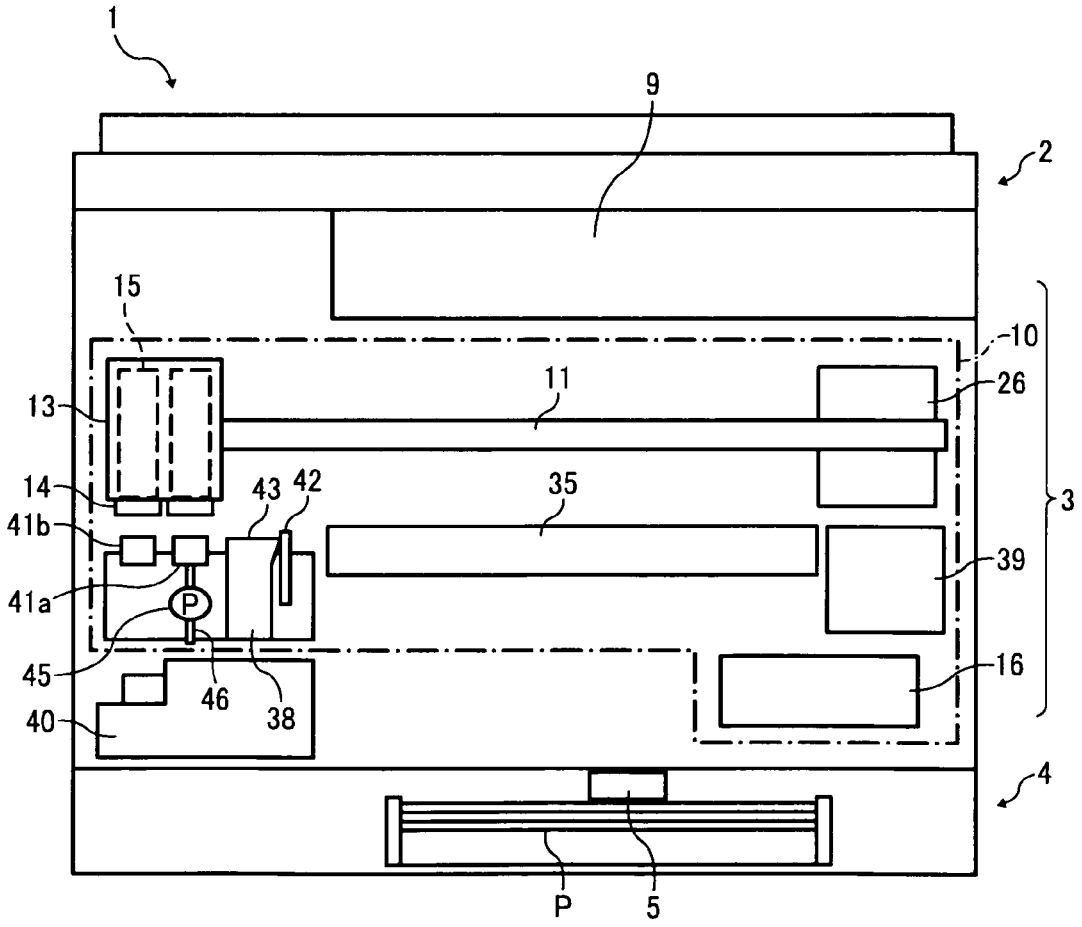
FIG. 2 is a schematic side view of the image forming apparatus of FIG. 1.
Figure 3:
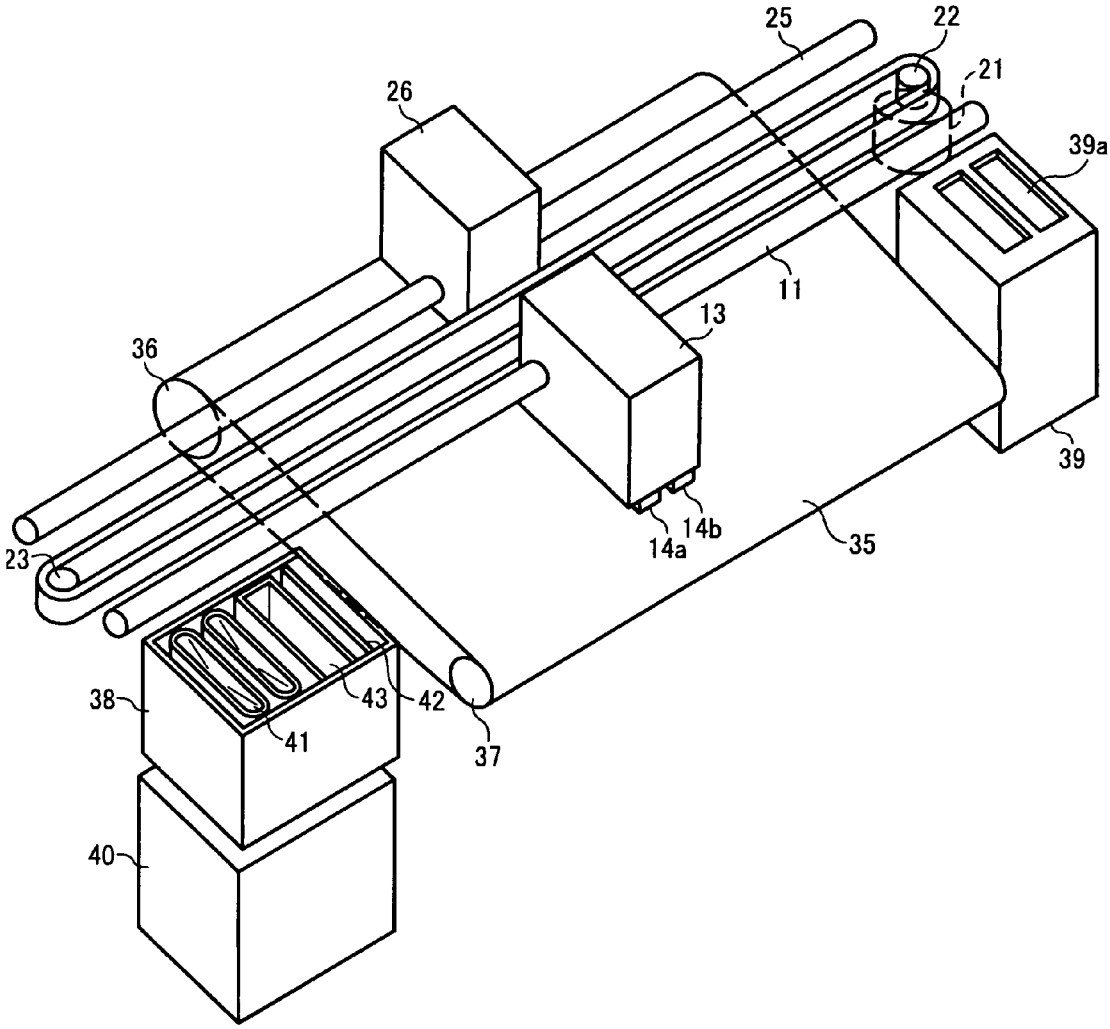
FIG. 3 is a perspective view illustrating a printing section of the image forming apparatus.
Figure 4:
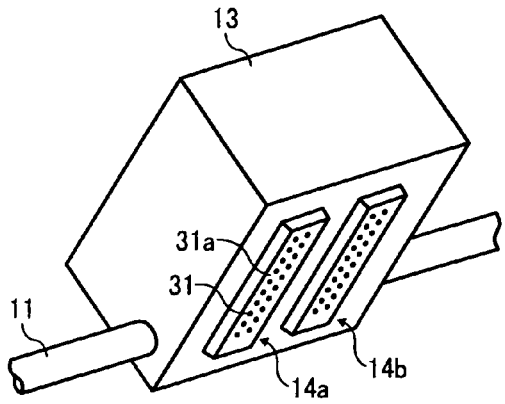
FIG. 4 is a perspective view illustrating a first carriage of the image forming apparatus as seen from a bottom face of the first carriage.
Figure 5:
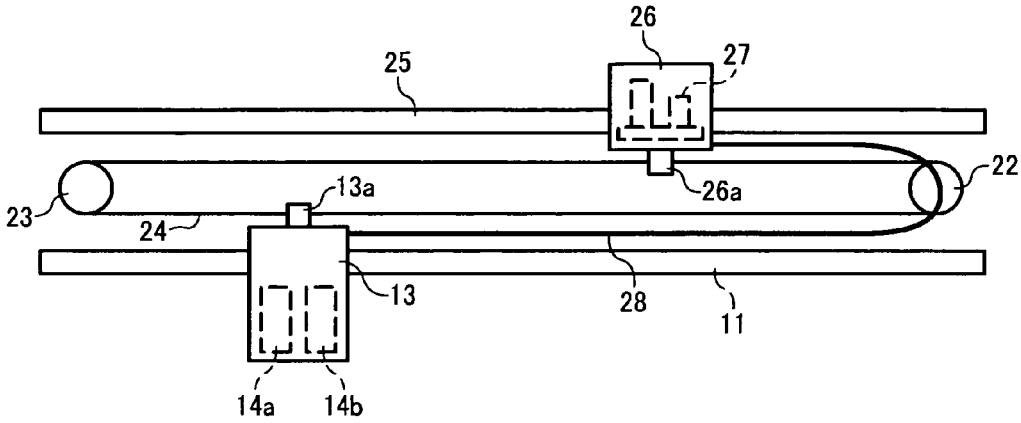
FIG. 5 is a plan view illustrating a state of operation of a carriage scanning mechanism of the image forming apparatus.
Figure 6:
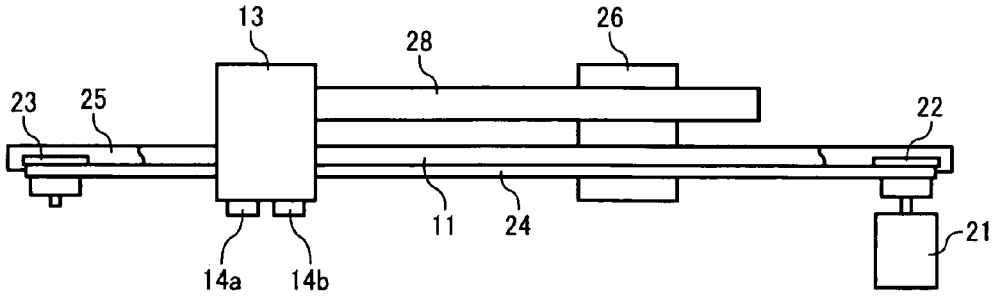
FIG. 6 is a front view illustrating the carriage scanning mechanism of FIG. 5.

FIG. 1 is a schematic view illustrating a configuration of the image forming apparatus 1. FIG. 2 is a schematic side view of the image forming apparatus 1. FIG. 3 is a perspective view illustrating a printing unit 10 of the image forming apparatus 1. FIG. 4 is a perspective view illustrating a first carriage 13 of the image forming apparatus 1 as seen from a bottom face of the first carriage 13. FIG. 5 is a plan view illustrating a carriage scanning mechanism. FIG. 6 is a front view illustrating the carriage scanning mechanism of FIG. 5.

As illustrated in FIG. 1, the image forming apparatus 1 includes an image reading unit 2, such as a scanner, to read a document image, a recording unit 3 to form an image on a sheet P, and a sheet feed unit 4 to feed a sheet P to the recording unit 3. A plurality of sheets P stored in the sheet feed unit 4 is separated sheet by sheet with a sheet feed roller 5 and a separation pad to be fed to a transport path 7. The sheet P is transported through the transport path 7 to the printing unit 10, in which an image is formed on the sheet P. The sheet P having the image is discharged through a discharge path 8 onto a discharge stack portion 9.

As illustrated in FIGS. 3, 5, and 6, in the printing unit 10, the first carriage 13 is supported with a carriage guide 11 and a guide stay (not illustrated) so that the first carriage 13 is movable on the carriage guide 11 in a main scanning direction. On the first carriage 13, recording heads 14*a* and 14*b* (hereinafter referred to collectively as "a recording head 14" or "recording heads 14" unless particularly distinguished) for ejecting ink droplets of yellow (Y), cyan (C), magenta (M), and black (K) are mounted so that nozzle arrays including a plurality of nozzles are arranged along a sub-scanning direction perpendicular to a main scan direction and ink droplets are ejected downward.

Each of the recording heads 14*a* and 14*b* includes, for example, two nozzle arrays. In such a case, black ink droplets may be ejected from one of the two nozzle arrays of the recording head 14*a* while cyan ink droplets from the other. Further, magenta ink droplets may be ejected from one of the two nozzle arrays of the recording head 14*b* while yellow ink droplets from the other.

The recording heads 14 may be a piezoelectric-type, thermal-type, electrostatic-type or other-type recording head. For a piezoelectric-type recording head, a piezoelectric device is used as a pressure generator (an actuator) to apply pressure against an ink channel (a pressure chamber) containing ink to deform a diaphragm forming one wall of the ink channel, thus changing the capacity of the ink channel and ejecting the ink droplets. For a thermal-type recording head, a heating resistive element is used to heat ink in an ink channel to generate bubbles and pressure, thereby ejecting ink droplets. For an electrostatic-type recording head, a diaphragm forming one wall of an ink channel is disposed opposite an electrode, and electrostatic force is generated between the diaphragm and the electrode to deform the diaphragm, thus changing the capacity of the ink channel and ejecting ink droplets.

The first carriage 13 mounts head tanks 15*a* and 15*b* (hereinafter referred to collectively as "head tank 15" or "head tanks 15" unless particularly distinguished) that supply respective color inks to corresponding nozzle arrays of the recording heads 14*a* and 14*b*. To the head tanks 15, respective color inks are supplied via corresponding supply tubes from ink cartridges 16 detachably mountable in the image forming apparatus 1.

As illustrated in FIGS. 5 and 6, a carriage main-scan mechanism that moves the first carriage 13 to scan in a main scan direction includes a main scan motor 21 serving as a driving source and a timing belt 24 serving as an endless belt member extending between a driving pulley 22 and a driven pulley 23. The first carriage 13 is connected via a connecting portion to the timing belt 24, and the main scan motor 21 is rotated to move the first carriage 13 along the main scan direction.

A second carriage 26 including one or more electrical components 27 is slidably mounted on a guide rod 25, and is connected to the timing belt 24 via a connecting portion 26*a* diagonally opposite the first carriage 13.

Figure 5A:
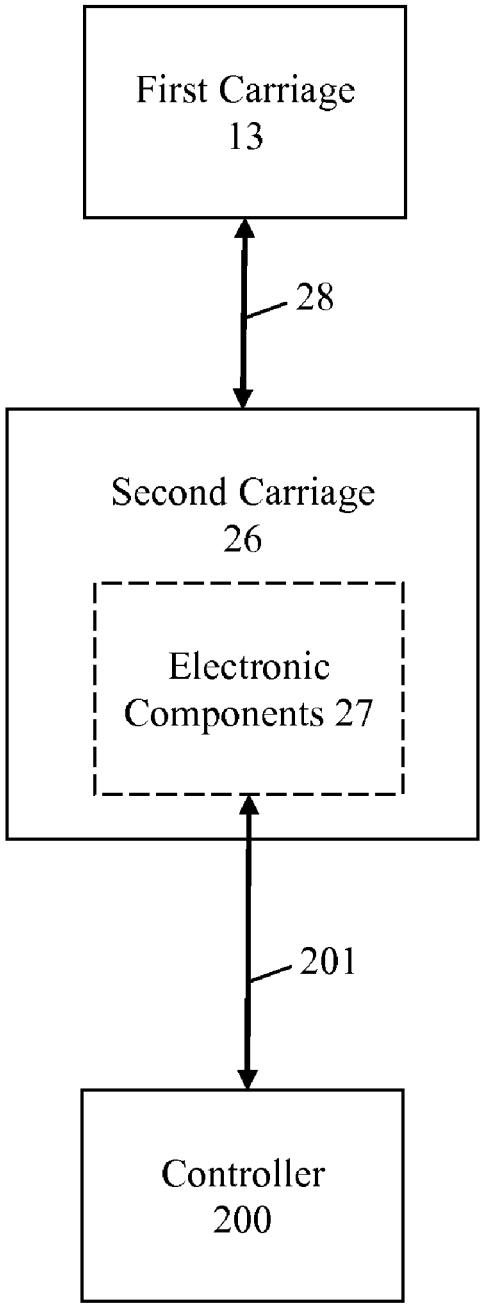

The first carriage 13 and the second carriage 26 are connected via a first flexible print cable 28 serving as a flexible signal-transmission member. The electrical component 27 of the second carriage 26 is electrically connected to a controller 200 (FIG. 5A) of the image forming apparatus 1 via a second, separate flexible print cable 201. The controller is connected to the first carriage 13 via the first flexible print cable 28.

Further, below at least the first carriage 13 is provided an endless-shaped transport belt 35 to transport a sheet P while electrically attracting the sheet P thereon. The transport belt 35 is extended between a driving roller 36 and a driven roller 37, so that circulation of transport belt 35 causes the sheet P to be transported in the direction perpendicular to the main scan direction. A charge roller 34 for charging the transport belt 35 is disposed so as to be rotated by circulation of the transport belt 35. The transport belt 35 may be configured to attract the sheet P on the belt 35 by creating a vacuum that attracts the sheet P thereto.

As illustrated in FIGS. 2 and 3, a maintenance-and-recovery mechanism 38 for servicing, that is, maintaining and nozzles of the recording head 13 and returning them to their original state of operation is disposed at a non-print area on one side in the scan direction of the first carriage 13, and a dry-run ejection receiving member 39 is disposed at a non-print area of the other side of the scanning direction.

The maintenance-and-recovery mechanism 38 includes a plurality of cap members 41 (a suction cap 41*a* and a moisturizing cap 41*b*) to cap nozzle faces 31*a* on which nozzles 31 are formed on the recording heads 14, a wiper blade 42 serving as a wiping member for wiping the nozzle faces 31*a* of the recording heads 14, and a dry-run ejection receiver 43.

A suction pump 45, e.g., a tube pump, is connected to the suction cap 41*a* so that suctioned ink is drained from the suction pump 45 via a drain tube 46 to a waste tank 40 for storing waste ink. The waste tank 40 is disposed below the suction pump 45, and the dry-run ejection receiving member 39 includes two openings 39*a*.

Figure 7:
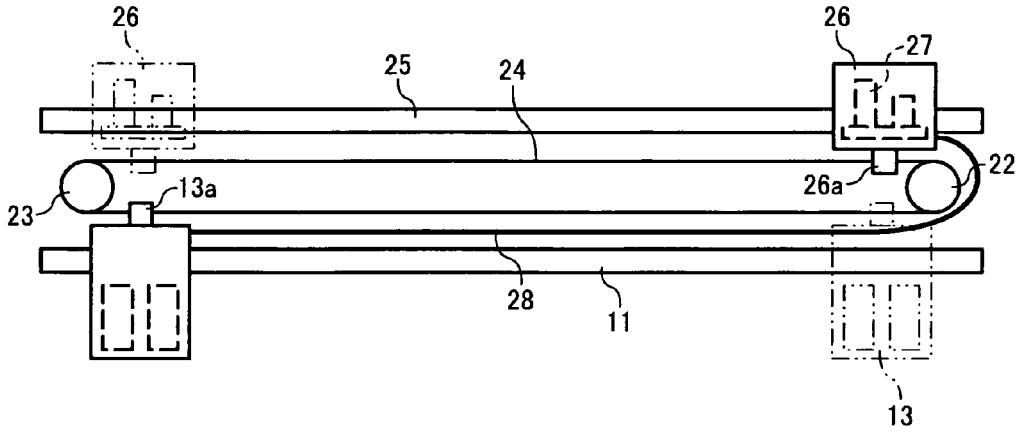
FIG. 7 is a plan view illustrating another state of operation of the carriage scanning mechanism of FIG. 5.
Figure 8:
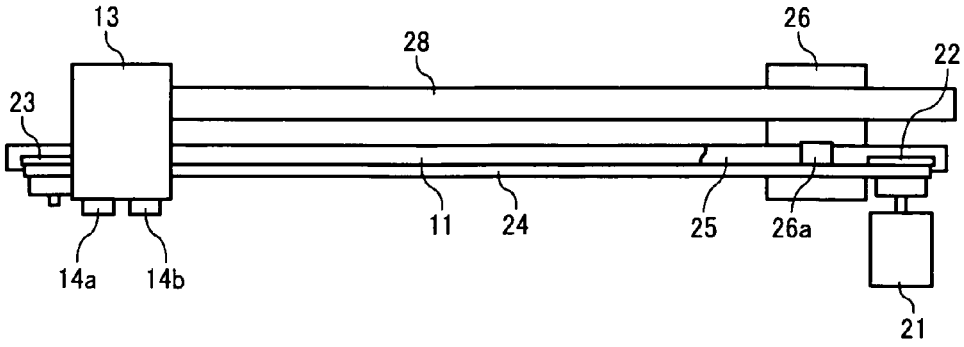
FIG. 8 is a front view illustrating the carriage scanning mechanism of FIG. 7.

In the maintenance-and-recovery mechanism 38 thus configured, as illustrated in FIGS. 7 and 8, when the first carriage 13 moves in the main scan direction to form an image by ejecting respective color inks from the recording heads 14*a* and 14*b* onto a sheet P transported by the transport belt 35, the second carriage 26 moves in a direction opposite to the moving direction of the first carriage 13. As a result, motion vectors of the first carriage 13 and the second carriage 26 point in opposite directions to cancel each other out, thereby reducing vibration or shock of impact to the image forming apparatus 1 due to reciprocating movement of the first carriage 13. In this configuration, when the first carriage 13 and the second carriage 26 are substantially equal in mass, the motion vectors of the first carriage 13 and the second carriage 26 in the respective directions can be substantially canceled out.

In the image forming apparatus 1, the second carriage 26 is not only a member for generating a motion vector pointing in the direction opposite to the moving direction of the first carriage 13 but, since the electric component 27 is mounted in the second carriage 26, an electric component otherwise mounted in the first carriage 13 may be also mounted in the second carriage 26 to reduce the weight of the first carriage 13. Thus, the motion vector of the first carriage 13 can be reduced, thereby further suppressing vibration or shock to the image forming apparatus 1.

As the electric component 27 above described, the second carriage 26 may mount, for example, a sheet detection sensor including a photo sensor for detecting the leading edge, the width, or both the leading edge and the trailing-edge of a sheet P transported by the transport belt 35, and further a sensor board constituting a signal processing circuit for processing signals from the sheet detection sensor. Further, the second carriage 26 and the first carriage 13 are connected via the first flexible print cable 28, allowing the electric component 27 of the second carriage 26 to be electrically connected to the controller of the image forming apparatus 1 via a third, separate flexible print cable connecting between the image forming apparatus 1 and the first carriage 13. Such a connection configuration also allows signals to be transmitted to the recording heads 14*a* and 14*b* mounted in the first carriage 13 via the second flexible print cable connecting between the second carriage 26 and the image forming apparatus 1.

A connecting portion between the timing belt (belt member) 24 and each of the first carriage 13 and the second carriage 26 is fixed. Accordingly, for example, the timing belt 24 may have a laminated structure in which electric wires are internally embedded to electrically connect the first carriage 13 and the second carriage 26 via connecting portions 13*a* and 26*a*, respectively.

As described above, the image forming apparatus according to the present illustrative embodiment includes the first carriage loading the recording heads, the second carriage mounting one or more electrical components, the endless belt member extended between the driving pulley and the driven pulley and connected to each of the first carriage and the second carriage disposed at diagonally opposed positions, and the driving source for rotating the driving pulley. Further, moving of the belt member moves the first carriage and the second carriage in opposite directions, thereby facilitating a reduction in the weight of the carriage loading the recording heads.

Figure 9:
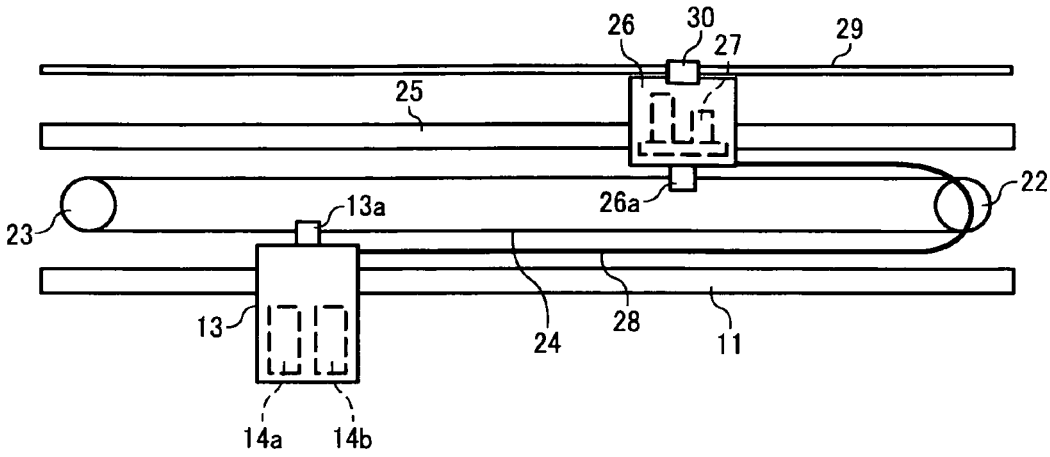
FIG. 9 is a plan view illustrating a carriage scanning mechanism of an image forming apparatus according to another illustrative embodiment.
Figure 10:
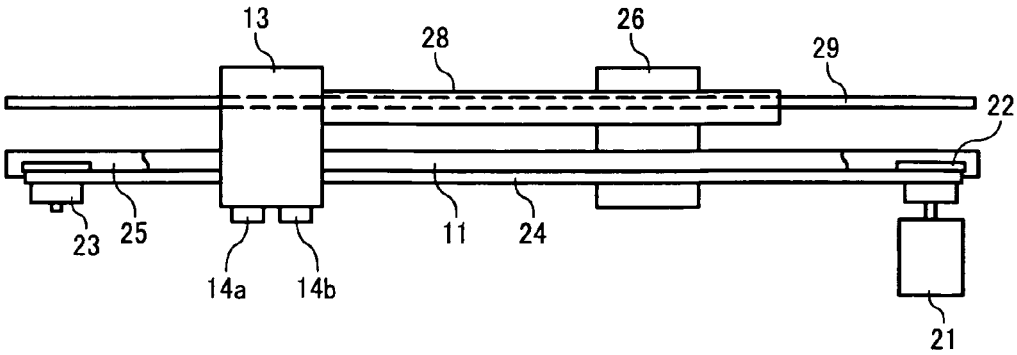
FIG. 10 is a front view illustrating the carriage scanning mechanism of FIG. 9.

Next, another illustrative embodiment of the present disclosure is described with reference to FIGS. 9 and 10. FIG. 9 is a plan view illustrating a carriage scanning mechanism according to the present illustrative embodiment. FIG. 10 is a front view illustrating the carriage scanning mechanism of FIG. 9.

In FIGS. 9 and 10, a linear encoder scale (encoder sheet) 29 serves as a position-information generation unit constituting part of a linear encoder for generating information on a main-scan position of a first carriage 13, and is disposed along a scanning area of a second carriage 26. The second carriage 26 is provided with a linear encoder sensor 30 serving as a reading device to read the linear encoder scale 29.

With such a configuration, the linear encoder scale 29 is located away from recording heads 14 that might generate ink mist, thereby suppressing inaccurate position detection due to adhesion of ink mist to the liner encoder scale 29. Accordingly, relatively high accuracy levels can be achieved and maintained in detecting the position of the first carriage 13, stably providing high-quality images.

Illustrative embodiments being thus described, it should be apparent to one skilled in the art after reading this disclosure that the examples and embodiments may be varied in many ways. Such variations are not to be regarded as a departure from the scope of the present invention, and such modifications are not excluded from the scope of the following claims.

What is claimed is:

1. An image forming apparatus, comprising:

a first carriage including a recording head;

a second carriage including one or more electrical components, the first carriage and the second carriage being electrically connected via a flexible cable;

an endless belt member extended between a driving pulley and a driven pulley, the first carriage and the second carriage being connected to the endless belt member at diagonally opposed positions;

a driving source configured to rotate the driving pulley, moving the belt member to move the first carriage and the second carriages in opposite directions;

a controller that controls recording operations of the image forming apparatus; and a second cable including another signal-transmission member electrically connecting an electrical component amongst the one or more electrical components on the second carriage to the controller, the controller being electrically connected to the recording head on the first carriage via the second cable and the first flexible cable, wherein the electrical component on the second carriage is a signal processing circuit that outputs one or more signals through the second cable to the controller.

2. The image forming apparatus according to claim 1, wherein the flexible cable includes a signal-transmission member extended between the first carriage and the second carriage.

3. The image forming apparatus according to claim 1, wherein the one or more electrical components of the second carriage includes a linear encoder sensor capable of reading a linear encoder scale to obtain position information of the first carriage.

4. The image forming apparatus according to claim 1, wherein the one or more electrical components of the second carriage includes a sheet detection sensor to detect a sheet on which an image is formed using the recording head.

5. The image forming apparatus according to claim 1, wherein the first carriage and the second carriage are substantially equal in mass.

6. An image forming apparatus, comprising:

a controller that controls recording operations of the image forming apparatus;

a first carriage including a recording head;

a second carriage including one or more electrical components thereon;

a first flexible cable electrically connecting the first carriage and the second carriage; and a second cable including a signal-transmission member electrically connecting an electrical component amongst the one or more electrical components on the second carriage to the controller, the controller being electrically connected to the recording head on the first carriage via the second cable and the first flexible cable, wherein the one or more electrical components on the second carriage includes a signal processing circuit that outputs one or more signals through the second cable to the controller.

7. The image forming apparatus according to claim 6, wherein the one or more electrical components on the second carriage includes a linear encoder sensor that reads a linear encoder scale to obtain position information of the first carriage.

8. The image forming apparatus according to claim 6, wherein the one or more electrical components on the second carriage includes a sheet detection sensor to detect a sheet on which an image is to be formed using the recording head.

9. The image forming apparatus according to claim 6, wherein the first carriage and the second carriage are substantially equal in mass.

* * * * *